US005584746A

United States Patent [19]

Tanaka et al.

[11] Patent Number: 5,584,746

[45] Date of Patent: Dec. 17, 1996

[54] METHOD OF POLISHING SEMICONDUCTOR WAFERS AND APPARATUS THEREFOR

[75] Inventors: Kouichi Tanaka; Hiromasa Hashimoto, both of Nishigo-mura; Fumio Suzuki, Taishin-mura, all of Japan

[73] Assignee: Shin-Etsu Handotai Co., Ltd., Japan

[21] Appl. No.: 283,152

[22] Filed: Aug. 3, 1994

[30] Foreign Application Priority Data

Oct. 18, 1993 [JP] Japan ..... 5-284393
Oct. 27, 1993 [JP] Japan ..... 5-291330

[51] Int. Cl.[6] ..... B24B 1/00; B24B 29/00

[52] U.S. Cl. ..... 451/41; 451/288; 451/289; 451/388; 451/398

[58] Field of Search ..... 451/41, 285, 287, 451/288, 289, 364, 388, 390, 397, 398, 402

[56] References Cited

U.S. PATENT DOCUMENTS

| | | | |
|---|---|---|---|
| 4,508,161 | 4/1985 | Holden | 451/388 |
| 4,671,145 | 6/1987 | Fehrenbach et al. | 451/388 |
| 4,918,869 | 4/1990 | Kitta | 451/288 |
| 5,029,418 | 7/1991 | Bull | 451/388 |
| 5,036,630 | 8/1991 | Kaanta et al. | 451/388 |
| 5,081,795 | 1/1992 | Tanaka et al. | 451/398 |
| 5,205,082 | 4/1993 | Shendon et al. | 451/398 |
| 5,398,459 | 3/1995 | Okumura et al. | 451/388 |
| 5,423,558 | 6/1995 | Koeth et al. | 451/388 |
| 5,441,444 | 8/1995 | Nakajima | 451/388 |

FOREIGN PATENT DOCUMENTS

| | | |
|---|---|---|
| 0362811A3 | 4/1990 | European Pat. Off. . |
| 0548846A1 | 6/1993 | European Pat. Off. . |
| 5069310 | 4/1991 | Japan . |

*Primary Examiner*—Timothy V. Eley
*Attorney, Agent, or Firm*—Whitham, Curtis, Whitham & McGinn

[57] ABSTRACT

A method of polishing semiconductor wafers and apparatus therefore are described. According to the present invention, a semiconductor wafer mounted on the lower side of a wafer mounting plate may be polished on a polishing pad by the front referenced polishing technique due to a flexibility of the wafer mounting plate to make the same to conform in detail with the backside contour of the wafer under polishing pressure and a selected flexibility differential between a wafer holding region and the outer moving region of the wafer mounting plate. An apparatus includes the wafer mounting plate that also works as a vacuum chuck plate is constructed out of a flexible thin disc of hard plastics, a central round region is used for a wafer holding region facing the backside of the wafer and the outside annular region is more flexible to work as a moving region, a pan-shaped rubber sheet is secured to a ring projection, the wafer mounting disc is adhered to the inner periphery of the rubber sheet at and along the periphery thereof to generate a sealed space, passes for vacuum communication and for a compressed air supply are formed through a rotary shaft, and vacuum chuck holes are communicated with the vacuum pass and the compressed air pass is in communication with a sealed space in the wafer holder.

18 Claims, 16 Drawing Sheets

FIG. 21(a)
FIG. 21(b)
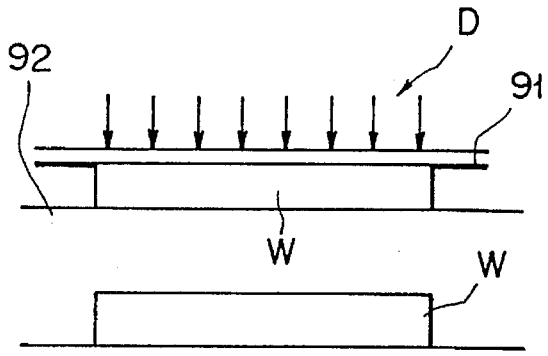
FIG. 22(a)
FIG. 22(b)
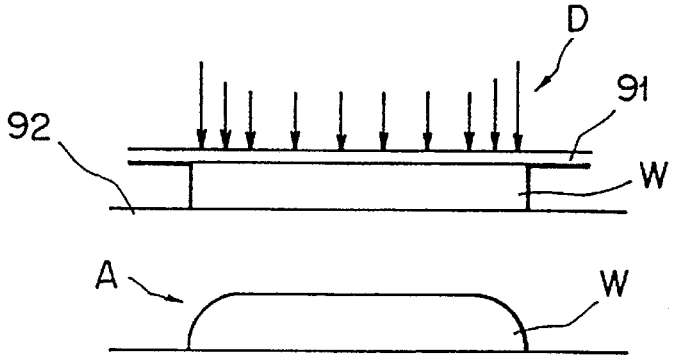

METHOD OF POLISHING SEMICONDUCTOR WAFERS AND APPARATUS THEREFOR

BACKGROUND OF THE INVENTION

1. Field of the Invention

The present invention relates to a method of polishing semiconductor wafers and apparatus therefor and, more particularly, a method of polishing semiconductor wafers and apparatus therefor suitable for a so-called planarization process to improve global surface flatness of a semiconductor wafer in the making in VLSI process.

2. Description of the Prior Art

Interconnections between components on top of a chip is increasingly demanding a larger space to occupy thereon, as the semiconductor industry further implements submicron technology. Therefore, miniaturization of patterns and usage of multi-leveled interconnections will take a more and more important role in VLSI technology. Along this trend in VLSI technology, a semiconductor wafer is required flat to close tolerances across one face thereof, where other materials are applied to form desired circuitry, that is, an interlevel dielectric film is deposited on the semiconductor wafer in preparation for further optical lithography to print miniature patterns for interconnections on the surface.

In the direction of the miniaturization the interconnections have a trend where the width of each interconnection will become narrower while the thickness is kept as it has been. Along this line of development in technology, insulator coverage on and around a wiring on a substrate grows poorer and poorer due to the structural sharpness of the recent wiring, which means a right angle to the base dielectric film or overhanging of the sides of the wiring on the substrate.

Progress in VLSI technology develops more and more stringent requirements on planarization processes. This trend accelerates application of the chemical mechanical polishing of silicon dioxide used as an interlevel dielectric film for the manufacture of VLSI chips.

Techniques presently used include glass reflow, bias sputter deposition, and a number of processes involving application of material in the liquid state by a spin process. None of these will planarize topography with a lateral dimension larger than 10 to 100 μm. Phosphorous-doped silicon dioxide is frequently used in order to ensure uniform coverage of the next conducting layer. Chemical deposition methods are used to produce the silicon dioxide film across a substrate as an insulator between metal layers, for example, interconnections, as well as a final passivation over devices, and as a gettering source.

Phosphorous-doped silicon oxides such as PSG and BPSG are applied on chips in the form of a film covering minute step structures on the surface, which is followed by heat treatment at a temperature in the range of 800° C. to 1100° C. to get the doped silicon oxides to flow as a viscous fluid for the purpose of smoothing the rough surface of chips being manufactured.

The planarization process using the doped silicon oxide film deposition can be thus accomplished only by flowing such dielectric at high temperatures, so that when the highest allowable substrate temperature is less than the oxide flow temperature, for example, Al metallization was adopted on the surface of the substrate, said planarization process cannot apply. Recently interest has focused on chemical mechanical polishing technique for planarization in VLSI technology because this technique can flatten much wider surface features than those in the prior art.

There are a number of issues that must be addressed in the conventional chemical mechanical polishing technique. According to the technique, the polishing pad is capable of conforming with the warp and bow of a semiconductor wafer and this nature of the pad allows levelling of device steps on a substrate, but in view of the severe requirement for flatness to close tolerances for use in VLSI technology, the conventional technique is still unsatisfactory, due to the very nature of the conventional technique, which has been developing only to improve the parallelism between the opposite faces of a semiconductor wafer and thereby to achieve a flatness of close tolerances on one of the opposite faces.

The planarization process, which development is needed for VLSI technology, must serve to realize uniform stock removal of the surface region regardless of local variations of the bulk thickness of a substrate (hereinafter referred to as a semiconductor wafer or simply a wafer, W) as shown in section in the making of a semiconductor device fabrication in FIG. 4. After the planarization process is applied, the wafer comes to have the surface topography as shown in section in FIG. 6. In other words, in the new approach, the conventional chemical-mechanical polishing technique is affected by the change of the basic nature and starts as a technique where the new chemical mechanical polishing technique should remove the surface region in reference thereto of a substrate, for example, a CVD deposited dielectric film and thereby eliminate minute step-like projections together to finally achieve a planarized new surface for the next process, for example, metalization for interconnections.

The thus modified chemical mechanical polishing technique is hereinafter referred to as front referenced polishing technique.

In some proposals of the new approaches for the chemical mechanical polishing technique, which have been disclosed and claimed, for example, in Japanese first publication No. 5-69310 and others as shown in FIG. 18, step-like oxide projections on the oxide film 63 deposited across a wafer 6, as shown in FIG. 4 are tried to be eliminated together with a part of the surface region. The reference numeral 62 appearing in FIG. 4 designates interconnections directly applied on a wafer surface.

The apparatus disclosed in the above mentioned Japanese first application entitled "An apparatus for mirrorpolishing wafers" uses a flexible elastic membrane 71, by which a wafer is carried on during polishing. The membrane 71 are tight-stretched at and along the full periphery with a uniform tension applied by securing the periphery to lower round end of the wafer mounting head 72. A fluid supply source 73 is arranged on the opposite side of the membrane 71 to the wafer W to feed a pressure adjusting fluid on the wafer W.

The reference numerals 74, 75 and 76 are respectively a rotary shaft, a ring guide plate (or template) adhered to the lower surface of the elastic membrane, and a polishing turn table.

According to the publication, the elastic membrane 71, which seals the wafer mounting head 72 in the shape of a ring, should be good in flexibility, whereby a uniform distribution of polishing pressure is applied across a wafer W, so that sloping A along the wafer periphery is prevented to occur to the polished wafer. The sloping A is illustrated in FIG. 22(*b*). A polished wafer without the sloping A is shown schematically in section in FIG. 21(*b*).

The apparatus for polishing as shown in FIG. 20 comprises a wafer mounting plate 81 made of a rigid material, a mounting pad 82 secured to and across the lower surface of the plate 81, a template 83 in the shape of a ring on the pad 82, a soft polishing pad 85 on the upper surface of a polishing turntable 84, and the polishing turntable 84.

During the polishing, the stock removal rate of the surface region of a wafer W is strongly dependent on the polishing pressure applied. Accordingly, the front referenced polishing technique claims as indispensable conditions of application the uniform strength distribution of polishing pressure applied to the polished surface of a wafer as shown in FIG. 21(*a*) (uniformly distributed pressure) and limitation of the pressure application within the back surface area (the surface opposite to the polishing surface) of the wafer W, where the reference numeral 91 in FIG. 21(*a*) designates a wafer mounting plate and the reference numeral 92 indicates a polishing pad.

According to the apparatus for polishing disclosed in the above mentioned first publication, the elastic membrane 71 is made in uniform thickness and tight-stretched at and along the full periphery in uniform tension to the wafer mounting head 72. Therefore as indicated in FIG. 19, in case that the clearance H between the lower surface of the periphery portion of the elastic membrane 71 and the upper surface of the polishing turntable 76 is narrower than a value, the pressure applied in the periphery portion of a wafer grows larger than normally required as illustrated in FIG. 22(*a*), whereby sloping A occurs along the wafer W periphery. On the other hand, as indicated in FIG. 23(*a*), in the case that the clearance H is wider than the value, the pressure acting along the wafer W periphery is by far smaller than that acting in the mid portion of a wafer, so that the periphery portion of the wafer is less polished than the other and permits a raised or high spot B as indicated in FIG. 23(*b*). The exact adjustment of the clearance H is rather difficult to achieve in the current level of the art.

In the apparatus for polishing as shown in FIG. 20, mounting a wafer to the mounting head is simple to operate due to the structure of the wafer holder. However the surface contour of a polished wafer is adversely affected by local fluctuations of characteristics of the mounting pad 82 (such as thicknesses, elasticities and degrees of degradation in use) and uniform pressure distribution across a wafer is difficult to realize. Consequently the sloping A around the wafer periphery portion as shown in FIG. 22 (*b*) and the raise as shown in FIG. 23(*b*) therearound are the problems to be solved for the apparatus.

As described above, with the conventional apparatus for chemical mechanical polishing, there are left unsolved a problem of poor uniformity of polishing pressure distribution due to functional deficiency of the wafer mounting plate, though the apparatus had been devised with an intention to improve the polishing pressure distribution. A very long way still remains technologically to reach the surface flatness of close tolerances applicable to VLSI technology by means of the front referenced polishing technique since in addition to the above mentioned problem errors in machine assembly and poor dimensional accuracy of components are yet to be overcome in order to apply a currently available level of the front referenced polishing technique to the purpose.

SUMMARY OF THE INVENTION

In view of the above described problems in the prior art, the present invention was made. It is an object of the present invention is to provide a method and apparatus to effectively perform the front referenced polishing in which the polished wafer is free from the sloping or raise along the periphery due to poor wafer mounting. It is another object of the present invention to provide a method and apparatus to effectively perform the front referenced polishing in which the surface flatness of the polished wafer is not degraded by inferior machine accuracy by poor assembly, limited accuracy of dimensions in machining of the components, or thermal or mechanical deformation during operation of the apparatus.

In a method according to a first aspect of the present invention, a wafer is secured to a wafer mounting plate in contact with the backside of the wafer and a compressed fluid is supplied to on the side of the upper side of the plate so as to press the wafer toward a polishing turn table, where the influence of the pressure of the compressed fluid is contained within a region of the upper side face of the plate just facing the backside of the mounted wafer.

In other words, the influence of the pressure does not extend outside the region. The wafer mounting plate may be a thin flexible plate made of a rigid substance on which the wafer is mounted, where the region of the flexible plate facing the wafer may be mated with the wafer in a almost perfect geometrical coincidence.

In an apparatus according to the first aspect of the present invention, the region of the wafer mounting plate on which the wafer is mounted has a flexibility due to the small thickness in spite of being made of a rigid substance is connected to a wafer mounting head along the full periphery of the region of the plate by way of a flexible ring member interposed therebetween and what's more the inner space of the wafer mounting head is communicated with a compressed fluid source.

The outside region of the wafer mounting plate may be designed to be more flexible than the region facing a mounted wafer, and the outside periphery of the plate may be directly secured to the lower end of the head.

The thickness across the plate may be changed in such a manner that it is thinner in the outside region than in the region facing the mounted wafer and thereby the flexibility is adjusted so as to be less flexible in the region facing a mounted wafer than in the outside region.

The thickness is selected in view of a pressure applied in wafer polishing, the elasticity and the like. In general, with a rigid plastic thin plate used as a structural substance, the thickness is preferably between 0.5 mm and 5.0 mm for the region facing a wafer mounted and between 0.3 mm and 3.0 mm for the outside region. With hard rubber thin plate used as a structural substance, the thickness is preferred to be between 1.0 mm and 8.0 mm for the region facing a wafer mounted and between 0.5 mm and 4.0 mm for the outsider region. Furthermore, with a metallic thin plate as a structural substance, the thickness is preferred to be between 0.1 mm and 1.0 mm for the region facing a wafer mounted and between 0.01 mm and 0.05 mm for the outside region.

Instead of adjusting the thickness locally, with a uniform thickness across the entire plate, the outside region may have many through-holes scattered across the surface or instead as many recesses with a thin bottom.

The region facing a wafer mounted may be arranged to have a plurality of vacuum chuck through-holes regularly positioned across the surface and those holes are hermetically sealed on the upperside with soft square rubber cords which have a long groove lengthwise in one of the four side faces, where the groove side is applied onto the upper side of the plate to be disposed to cover the vacuum chuck through-holes and thus a vacuum source may be communicated with all the vacuum chuck through-holes through a single connecting hose, the lower end of which is hermetically secured to a vacuum port of the plate, where the vacuum port is further communicated with all the through-holes by means of the square rubber cords as described above. The square rubber cords adhered on to the backside of the plate does not affect the total flexibility of the region.

The inner space of the wafer holder may be sealed by securing the full periphery of a flexible ring member 17 constructed out of a soft rubber sheet to an inner portion of the head, the inner periphery of which is again adhered to the full periphery of the region of the wafer mounting plate 19, as shown, for example, in FIGS. 7, 9 or 10.

Instead of the square rubber cords, plastic sponge or aggregate of elastic fibers, that is, three-dimensionally open cellular structure is applied directly to the perforated surface and further a rubber sheet is used to cover all the plastic sponge or the aggregate of elastic fibers hermetically and still further the underside of the rubber sheet is connected pneumatically to a vacuum source at a vacuum port arranged thereon above the plate center portion.

A soft rubber plate, a lower side of which a spiral groove is formed across, may be superimposed on the wafer mounting plate so that the spiral groove is positioned to communicate with all the vacuum through-holes in full and further the spiral groove of the soft rubber plate is hermetically connected to a vacuum source by way of a flexible hose.

Thus far, the present invention is always described with an emphasis on a method and apparatus for polishing a wafer at a time. however, a plurality of the structures similar to the wafer mounting plate with a wafer mounted thereunder and the components accompanied may be contained in the same opening of a larger wafer mounting head.

In the above mentioned method of and apparatus for polishing wafers. a wafer is mounted on the lower side of the wafer mounting plate, a compressed fluid, for example, air is supplied to the space above the wafer from a compressed fluid source, and the wafer is pushed onto a polishing turntable at a pressure by the displacement of the plate by increase in the pressure of the space, so that the wafer polishing is operated on in the usual manner of the prior art.

The flexible ring member is expandable or shrinkable to follow the displacement of the plate according to the pressure of the fluid in the space.

The plate is constructed out of a thin plate of hard rubber and the like in the region facing a wafer mounted, so that the wafer is applied across the whole backside with uniform polishing pressure and that with application of the pressure strictly limited within the backside of the wafer as well as with flexible local deformation of the plate exactly following the surface contour of the backside of the wafer. However global deformation of the wafer, for example, bow is straightened on a polishing pad under polishing pressure.

Further according to the first aspect of the present invention, the inner periphery of the flexible ring member is secured to the periphery region of a wafer mounting plate facing a wafer mounted and the region facing the wafer is only applied with the pressure, so that the ring member works as a moving region together with the outside region and thereby errors in the machine assembly, poor dimensional accuracy of the components, or the thermal or mechanical deformation built-up with time elapsed in operation, which otherwise unavoidably amount to values on the order of μms to tens of μms in an extreme case, does not affect on the flatness even of close tolerances of the polished wafer surface required in VLSI technology.

In an apparatus for polishing wafers according to a second aspect of the present invention, the apparatus in which a wafer mounting plate directly secures the backside of a wafer on the lower side and a compressed supplied on to the upper side and the wafer is polished in contact under pressure with a polishing pad, comprises a wafer mounting head with a cylindrical body open downward and an annular downward projection integral therewith on the ceiling, a wafer mounting plate concentrically secured on the lower end of a short hollow cylinder and arranged by a template for surrounding and receiving a wafer on and along the full periphery of the lower surface of the plate, a sealed space produced by hermetically connecting an expansion pipe both with the annular downward projection and with the plate respectively, a highly flexible support for supporting the plate in place secured both on and along the inner periphery of the cylindrical body open downward and along the outer periphery of the short hollow cylinder, and a flexible hose hermetically connected both with a vacuum port in the center portion of the ceiling and a vacuum port in the center portion of the upper side of the plate.

In the apparatus, the plate may be structured out of a rigid thin plate with less flexibility than that of the flexible supporter surrounding the plate inside the cylindrical body of the head, where the flexible supporter serves the only one moving region within the head.

Further, the sealed space in the head is designed to be in the rough duplicates in shape and dimension of section both on the side of the plate and on the side of the head.

As for the rigid thin plate for making of the wafer plate mounting plate, for example, thin plates made of hard plastics, hard rubber, metal and so on may be listed.

The hard plastics comprises such thermosetting resins as epoxy resin, phenol resin and such heat resistant hard resins as polyethylene terephtalate, polybuthylene telephtalate, polyimide, polysulfone and so on and they may be reinforced by glass fibres, carbon fibers, woven or nonwoven stuff thereof or the like.

As for the thickness of the plate made of the above substances, the hard plastics and hard rubber, including the substances with reinforcement by the above mentioned fibres or the fabrics thereof, preferably have a thickness in the range of between 0.1 mm and 1.0 mm so as to show their flexibility in the form of a plate. The thicknesses according to the second aspect of the present invention are in general thinner than those of the first aspect of the present invention due to the structural differences therebetween around the wafer mounting plate.

In the case of metal, steel is preferably selected to use and stainless steel is especially preferred. The thickness of the plate may be chosen in the range between 0.05 mm 0.2 mm to secure the flexibility in the form of a plate.

In the apparatus according to the second aspect of the present invention, the wafer carrier is suspended in the inner space of the wafer mounting head by the expansion pipe and the flexible supporter respectively secured to the different portions of the head, so that in a way similar to or more effective than the apparatus according to the first aspect of the present invention, errors is the machine assembly, poor dimensional accuracy of the components, or the thermal or mechanical deformation accumulated in the structure with time past in operation, which unavoidably amounts to a level on the order of μ ms or tens of μ ms in the worst, do not any more affect the flatness of a polished wafer to close tolerances and what's more the wafer is pressed on in a stable and assured way onto the polishing pad during operation.

The mounted wafer is directly held on the lower side of the flexible plate and the flexible plate is pressed from the upper side by the compressed air. The bow of the wafer is thereby corrected and the plate itself is deformable following the local variation of the wafer thickness while still keeping the direct contact all over the wafer back surface, so that the polishing surface of the wafer may be brought into a close contact as a whole with the polishing pad without any transmission of projections or recesses on the back surface to the front surface. In other words, the plate is permitted to be geometrically adaptable even in a microscopic sense to the surface contour of the wafer backside due to the cushioning effect of resilience.

The wafer carrier comprises the short hollow cylinder that is rigid which supports the periphery of the plate and the plate which consists of the region facing a mounted wafer and the periphery region more flexible than the former and forming a moving region. Accordingly, the flexible supporter does not deform the central region since the deformation in the shape of the flexible supporter can not propagate across the moving region toward the center region of the plate, where the deformation of the flexible supporter is caused by the tensions generated within the supporter during the polishing.

The vertical component of the tension of the flexible supporter and the self weight of the short hollow cylinder, combined, are received by the template which is arranged beneath the plate periphery portion and which surrounds a wafer within and the force pressing down the center region may be the one from a compressed air only and thereby the pressure acting the polishing front face may be controlled to be uniform across the whole face.

In the case that a sectional area of the sealed space on the side of the wafer mounting head is larger than that on the side of the wafer carrier, that is, the area of one of the wafer faces, the force acting from the side of the mounting head is larger than that, based on the pressure of the compressed air, pushing the wafer to the polishing pad from the wafer back side due to uniformity of the air pressure within the sealed space, so that the difference in magnitude between the forces is transmitted to the template by way of the short hollow cylinder and at the same time from the wafer mounting plate to the wafer. In the circumstances, the force applied to the template is too large to keep the operational conditions for polishing reasonably well and thereby the polishing pad is not only accelerated to degrade, but also the feed of a polishing slurry onto the polishing surface of the wafer is interfered with during polishing, while the force transmitted to the wafer mounting plate brings about lack of spatial uniformity of the pressure to press the wafer to be in close contact with the polishing pad.

In the case that a sectional area on the side of the wafer mounting head is smaller than that on the side of the wafer carrier, such problems as those caused in the above conditions are brought about as well.

However, in case that both of them are not only the same but also the shapes of the sectional area are same according to the present invention, the force acting on the wafer consists of the only one force, which is the air pressure, and thereby the polishing pressure may be uniform across the polishing face.

According to the present invention, as described above and made clear from the above explanation, the polishing pressure across the polishing face comes to be uniformly applied all over and thereby stock removal rates are constant at any point across the face, so that the front referenced planarization polishing may become a reality in practical use.

The present invention includes other features and advantages which will be discussed or will become apparent from the following more detailed description of preferred embodiments.

BRIEF DESCRIPTION OF THE DRAWINGS

The above mentioned and other features and objects of the present invention will become more apparent by reference to the following description taken in conjunction with the accompanying drawings, in which:

FIG. 21 is a schematic illustration of a preferred polishing condition of a wafer, where (a) illustrates a polishing pressure distribution profile on the wafer and (b) is a sectional view of the wafer as polished;

FIG. 22 is a schematic illustration of an undesirable polishing condition of a wafer, where (a) illustrates a polishing pressure distribution profile on the wafer and (b) is a sectional view of the wafer as polished;

DETAILED DESCRIPTION OF THE PREFERRED EMBODIMENTS

Referring to the embodiments shown in the accompanying drawings, the first aspect of the present invention will be illustrated in a more detailed manner.

EXAMPLE 1

Figure 1:
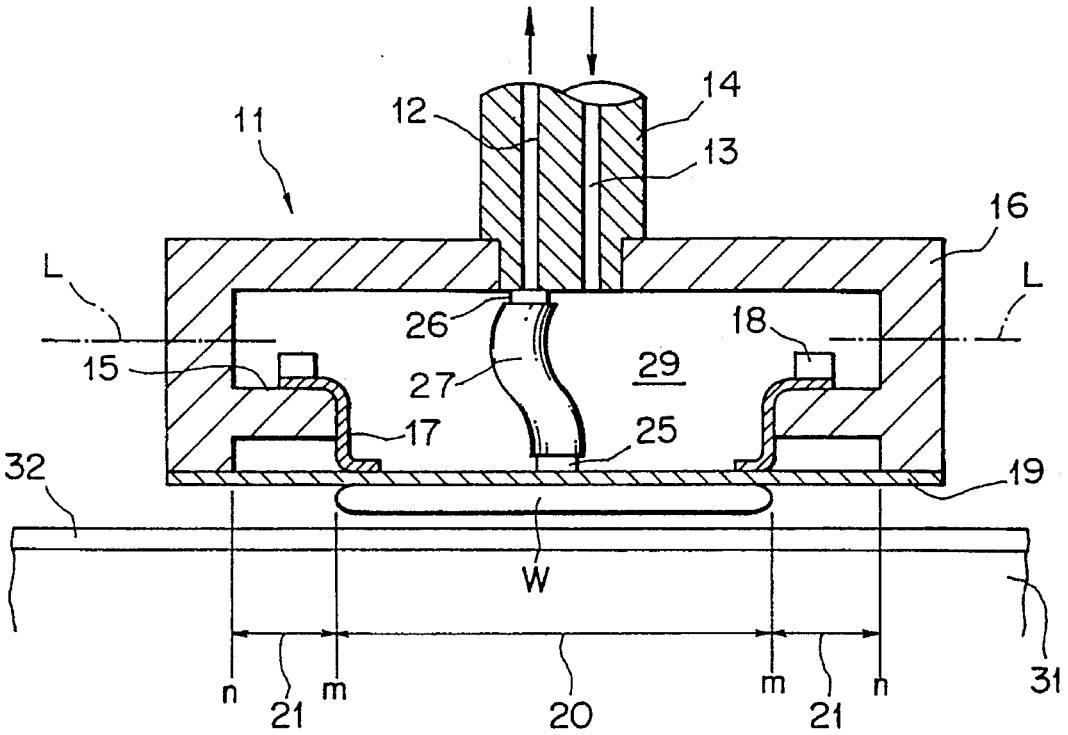
FIG. 1 a sectional view showing a first example embodying the principal part of an apparatus according to the first aspect of the present invention.
Figure 2:
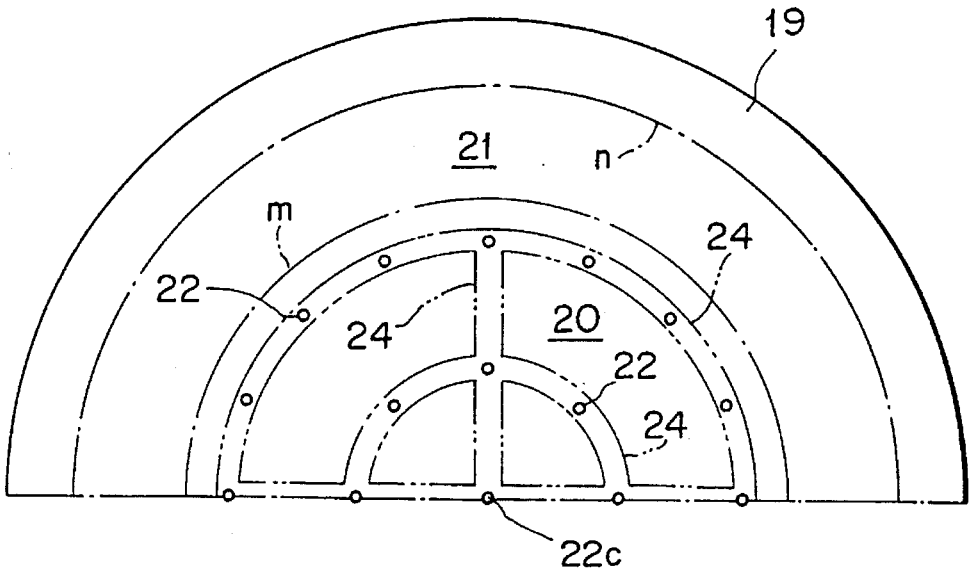
FIG. 2 is a plan view of the wafer mounting plate shown in FIG. 1.
Figure 3:
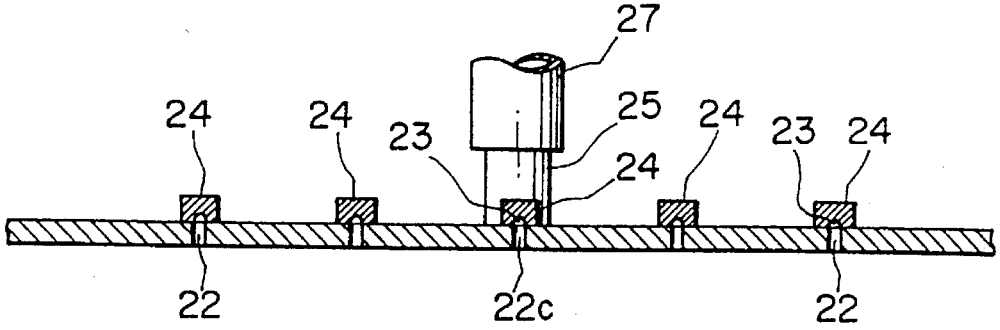
FIG. 3 is a sectional view of the wafer mounting plate shown in FIG. 1.

FIG. 1 is a sectional view of the principal part of an apparatus for polishing a semiconductor wafer, where only one wafer is polished at a time. FIG. 2 is a plan view of the wafer mounting plate (hereinafter referred to as a mounting plate(s)) FIG. 3 is the sectional view of the mounting plate.

In the embodiment, the mounting plate works as a vacuum chuck plate having a plurality of vacuum chuck holes therein and as shown in FIG. 1. The wafer holder 11, which carries and turns a wafer thereon, is facing the polishing pad 31 and adapted to be shiftable both upward and downward. The wafer mounting head 16 and mounting plate 19 are the principal parts of structure of an apparatus according to the first aspect of the present invention. The wafer holder 11 comprises the rotary shaft 14, through which the passages 12 and 13 are formed, the wafer mounting head 16 that is hollow and cylindrical, which is secured to the lower end of the rotary shaft 14, the ring projection 15 that is horizontally and inwardly extending, which is secured integrally to the inner periphery wall of the wafer mounting head 16 and the wafer mounting plate 19. The rotary shaft 14 is adapted to be rotatable and shiftable vertically by an external drive.

The passages 12 and 13 are communicated with a vacuum pump and a compressor (neither of them shown) respectively.

The ring projection 15 of the wafer holder 16 works as the place on which the upper flange of a pan-shaped highly elastic sheet, for example, a rubber sheet 17, is secured with screws and an annular mounting member 18 superimposed on the upper flange of the pan-shaped sheet 17, where the pan-shaped sheet 17 has a downward round opening in the centre portion, and effectively seals the annular securing portion on the upper face of the ring projection 15 with the elasticity of its own. The downward round opening of the sheet 17 has the same diameter as that of a wafer to be polished.

The wafer mounting plate 19 is constructed out of a round thin disk made of such hard substances as hard plastics, hard rubber, metal and the like and thereby is designed to have some flexibility. The wafer mounting plate 19 comprises a round wafer holding region (a portion facing a wafer mounted) 20 in the center portion and the outside annular region 21, which is designed to be more flexible than the wafer holding region 20, which constitutes a moving region. The difference in flexibility between the wafer holding region 20 and the moving region 21 is realized by, for example, making the thickness of the moving region 21 thinner or perforating a plurality of through-holes in the outside annular region 21 as will be described later in more detail.

The mark m in FIGS. 1 and 2 indicates the boundary between the wafer holding region 20 and the moving region 21 and the mark n indicates the boundary between the moving region 21 and the inner periphery of the lower end of the mounting head 16, where the mounting plate 19 is also secured onto the lower end.

The holding region 20 of the mounting plate 19 has a plurality of vacuum chuck holes 22 (hereinafter referred to as a chuck hole) perforated through as shown in FIG. 2. On the occasion, the chuck holes 22 consist of one in the center portion of the holding plate and the others arranged on a plurality of concentric circles around the center. As shown in FIG. 3, the thin, narrow soft rubber cords 24 (or soft plastic codes) with a long groove on one of the four sides are adhered onto the upperside surface of the mounting plate 19, which is the surface opposite to the surface where a wafer is mounted and thereby, seal all the chuck holes 22 including a vacuum hole 22*c* in the center portion to get each of the chuck holes 22 to hermetically communicate with all the other holes 22.

The hollow connector 25 (see FIG. 1 and 3) is mounted as a vacuum port at the chuck hole 22*c* in the center portion. Again another hollow connector 26 as a vacuum port is mounted at the opening end of the passage 12 formed through the rotary shaft 14 and the flexible hose 27 constructed out of a rubber hose is arranged between the connecters 25 and 26 for a hermetic communication.

The outer periphery of the holding plate 19 is secured with screws along the lower end of the wafer mounting head 16. The wafer holding region 20 of the holding plate 19 is adhered along the full outer periphery to the annular lower end of the rubber sheet 17 to generate a sealed space 29 within the wafer holder 11.

The structure as shown in FIG. 1 of the wafer holder 11 may be preferably divided into the two portions comprising the upper and the lower halves in order to be easy to overhaul or assemble. For example, the structure is designed so as to be dismantled into the two portions being in a fitting relation at a horizontal intersecting plane on the alternate long and short dash line L—L in FIG. 1 and to be set up with suitable fixturing means such as bolts and nuts in assembly.

In this case, an easy and quick assembly may be realized in the steps of securing the mounting plate 19 onto the lower half of the wafer mounting head 16, connecting the flexible hose 27 with the vacuum ports 25 and 26, finally combining and fixturing the two halves into one.

The mounting plate 19 comprises the wafer holding region 20 and the moving region 21 which is higher in flexibility than the wafer holding region (the examples will be explained later) and the full periphery of the holding region 20 is secured on the rubber sheet 17 and besides the periphery of the mounting plate 19 is secured to fix on the lower end of the wafer mounting head 16. Errors in the machine assembly, poor dimensional accuracy in fabrication of the components, or thermal or mechanical deformation accumulated with time elapsed in operation, which may amount to an order of magnitude of μ ms to tens of μ ms in the worst case is accommodated by the structure just illustrated above of the present invention and thereby the structure may properly execute the front referenced polishing, where in addition to the above advantages the wafer under polishing may keep a steady position against the friction of polishing thanks to the special structure of the present invention.

Instead of the rubber sheet 17 as a pan-shaped sheet, a plastic sheet in the shape of bellows may be used. Substance and a structure of the pan-shaped sheet have a limitation on the nature that the sheet may be freely shrinkable or extendible in accordance with the fluid pressure inside the wafer holder 11.

Substances for constructing the mounting plate 19 are required to have such properties as a mechanical strength, flexibility, elasticity and heat resistance in suitable respective levels. Preferable among plastics are, for example, thermosetting resin, heat resistant thermoplastic resin, reinforced resins thereof mixed with glass fiber or plastic fiber, or laminated sheet thereof reinforced with fibres or paper.

A thin plate made or constructed out of hard rubber or thin metallic sheet with anticorrosive properties may be used as substitute for plastic plate.

The polishing pad 32 mounted on the polishing turntable 31 should not be subject to plastic deformation and may preferably be selected from a group comprising polishing pads constructed out of close cell type of polyurethane foam, polyurethane impregnated polyester non woven fabric and the like, which are well known in the prior art.

Next, the operation of the above mentioned polishing apparatus will be illustrated with reference to FIGS. 1 through 6. The vacuum pump is actuated to reduce pressure in the holes in the mounting plate 19 and gap between the mounting plate 19 and the wafer W through the passage 12, whereby the wafer, as shown in section in FIG. 4 (where for better understanding the global surface undulation and minute step projections are shown in exaggeration.), is vacuum chucked on the mounting plate 19. On this occasion, it is important to have the periphery of the wafer to coincide with the periphery of the wafer holding region 20 of the mounting plate 19.

Further, the compressor gets started to feed a compressed air controlled at a given pressure to the sealed space 29 and thereby the mounting plate 19 and the rubber sheet 17 are displaced in a mutual positional relation kept unchanged with each other to force the wafer to be pressed onto the polishing pad 32 and in due course to get the wafer being polished under the well known mechanism.

On this occasion, the rubber cords 24 are used to have the vacuum holes 22 in the plate 19 to be communicated with each other, so that the loss in flexibility is not brought about to the wafer holding region 20 of the mounting plate 19 and in addition to that, the flexible hose 27 is adopted as a member to communicate the mounting plate 19 with the passage 12 for evacuation and as a result the mounting plate 19 is free to displace the position in accordance with the pressure of the compressed air fed by way of the passage 13.

What's more, the wafer mounting plate 19 is secured to the lower end of the wafer mounting head 16, whereby the wafer may keep a constant position against the frictional force acting on the polishing surface of the wafer.

Figure 4:
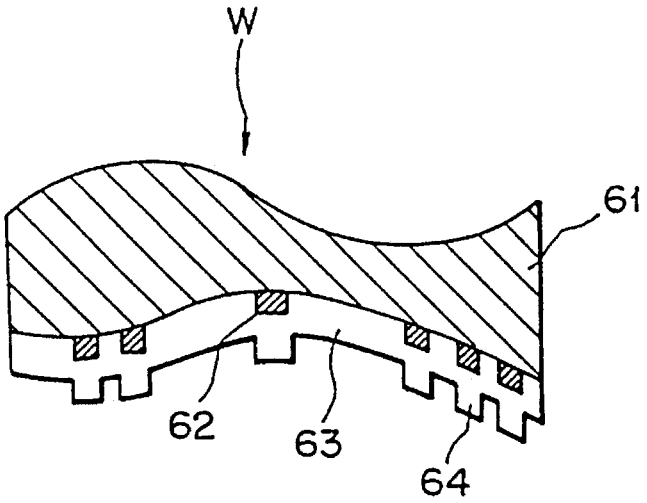
FIG. 4 is a sectional view of a wafer before polishing.
Figure 5:
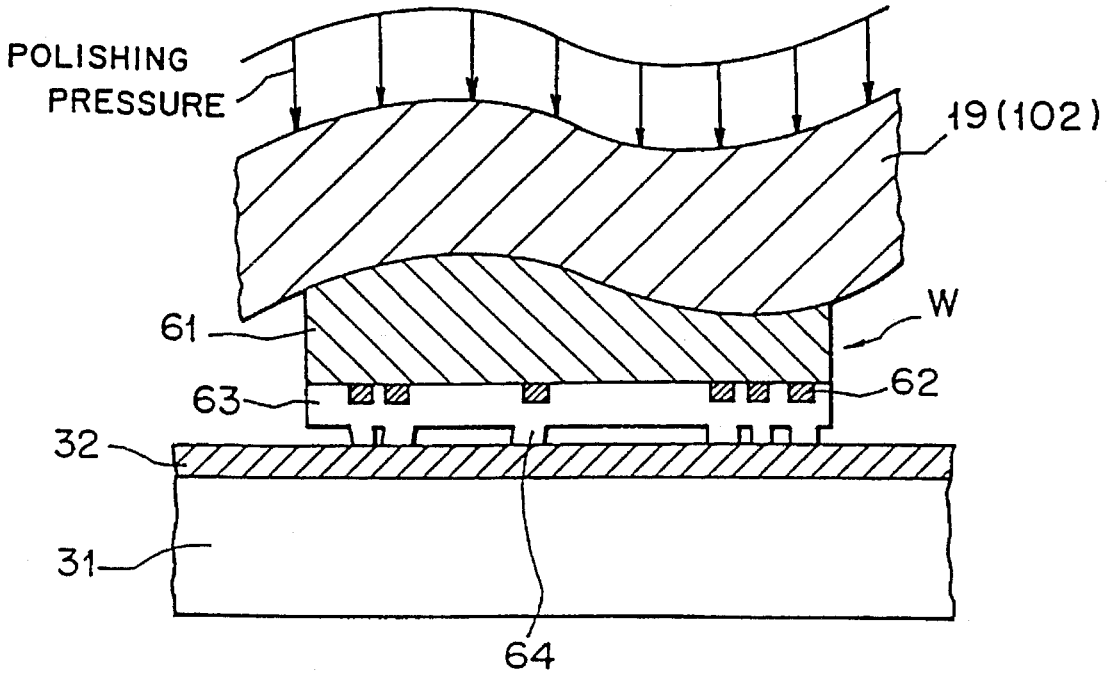
FIG. 5 is a sectional view illustrating the polishing mechanism working in the front-referenced polishing technique.

According to the above contrivances, the oxide film 63 covering the wafer front face is, as shown in FIG. 5, kept in a stable close contact with the polishing pad 32 all over the surface and in due course is polished in such a manner that the mounting plate 19 is kept under uniformity of polishing pressure across all the upper face and that in a condition in which the region thus under the influence of the polishing pressure is strictly confined within the back face space of the wafer W and in addition the mounting plate 19 is deformed to copy the wafer back surface in the surface morphology adapted in detail thereto. On the front face of the wafer W after polishing, as described above, minute step projections on the oxide film 64, as shown in FIG. 4, which correspond to interconnections 62 deposited on the preceding surface, with the one to one basis, are selectively polished faster with less stock removal on the other areas and without periphery slopings due to more local removal rates or high spots generated due to less local removal rates around the wafer periphery region, whereby the thickness of the oxide 63 remains flat and parallel to the preceding surface during the polishing according to the above embodiment of the present invention.

Another embodiment of the first aspect of the present invention will be explained with reference to the example below described. The apparatus for polishing have a wafer mounting plate 19, which is spatially divided into a moving region 21, higher in flexibility than a wafer holding region 20, and the wafer holding region 20.

EXAMPLE 2

Figure 7:
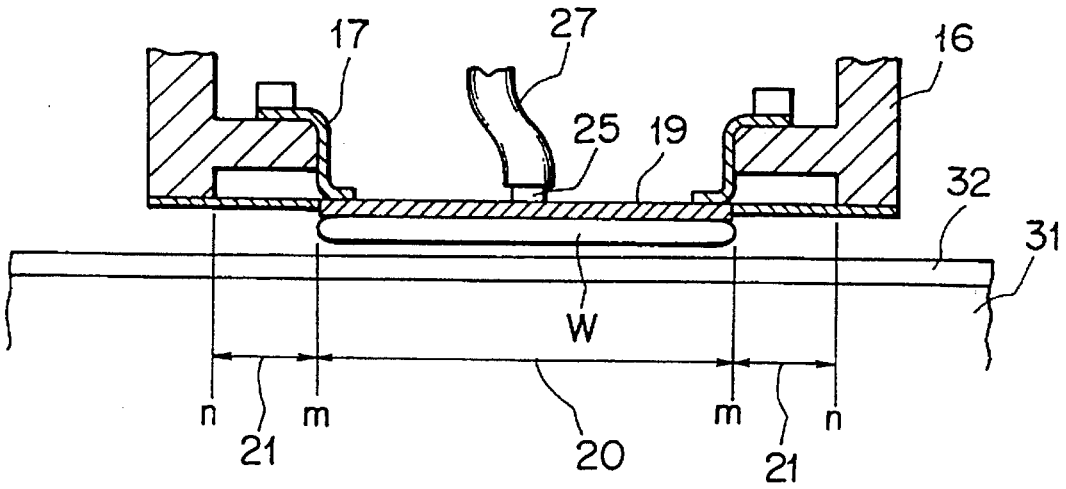
FIG. 7 is a sectional view showing a second example embodying the principal part of an apparatus according to the first aspect of the present invention.

In the example, the mounting plate 19 is constructed out of one and the same substance and as shown in FIG. 7, the moving region 21 smaller in thickness than the holding region 20.

The preferred range of the thickness of the mounting plate 19 is affected by the polishing pressure of a wafer and the elasticity of the substance constructing the mounting plate. However, in ordinary polishing conditions, as for a hard plastic thin plate, the thickness may be preferably selected in the range of 0.5 mm ~ 5.0 mm for the holding region 20 and in the range of 0.3 mm ~ 3.0 mm for the moving region 21, as for a hard rubber thin plate, in the range of 1.0 mm ~ 8.0 mm for the holding region 20 and in the range of 0.5 mm ~ 4.0 mm for the moving region 21, and as for a metal thin plate, in the range of 0.1 mm ~ 1.0 mm for the holding region 20 and in the range of 0.01 mm ~ 0.05 mm for the moving region 21.

As compared to a second aspect of the present invention which will be later explained following the first aspect, an apparatus according to the first aspect in general adopts a thicker plate with respect to both the wafer holding region 20 and moving region 21, since the first aspect lacks in the rigid short hollow cylinder 101 (FIG. 24) of the second aspect surrounding the mounting plate 19 and being kept strictly in a body therewith when moving.

EXAMPLES 3 and 4

Figure 8:
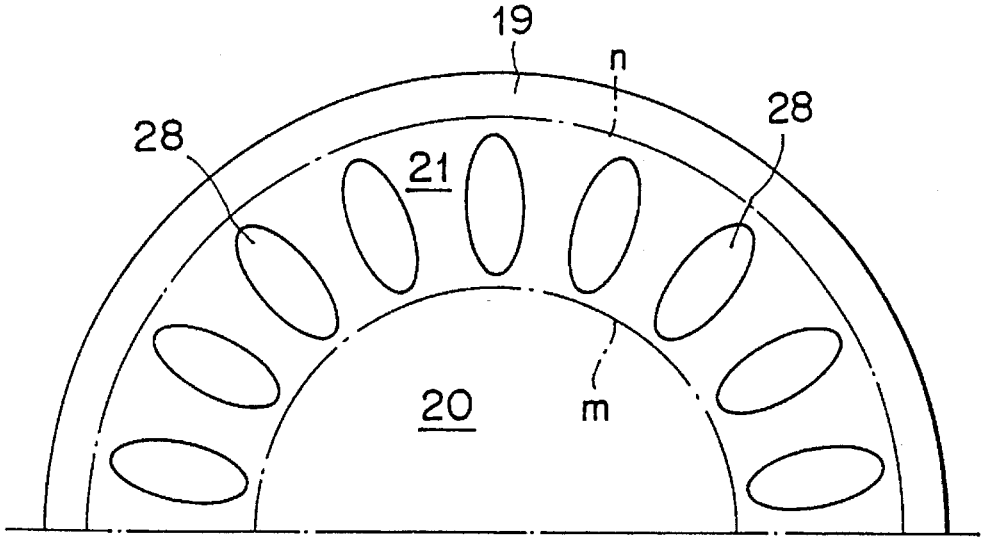
FIG. 8 is a schematic plan view showing a third example embodying the principal part of an apparatus according to the first aspect of the present invention.

In the example 3 of the embodiment, the wafer mounting plate 19 is constructed as shown in FIG. 8 out of one and the same substance and a thin plate having a uniform thickness across it and includes a moving region 21 with a plurality of through-holes 28 in the shape of ellipse, circle or segment, where instead of through-holes 28 a plurality of recesses in the same shapes may be adopted with the thin recess bottom thereof, and with a plurality of the recesses dispersed almost all over the moving region 21, eventually making the average thickness of the region to be thinner.

Figure 9:
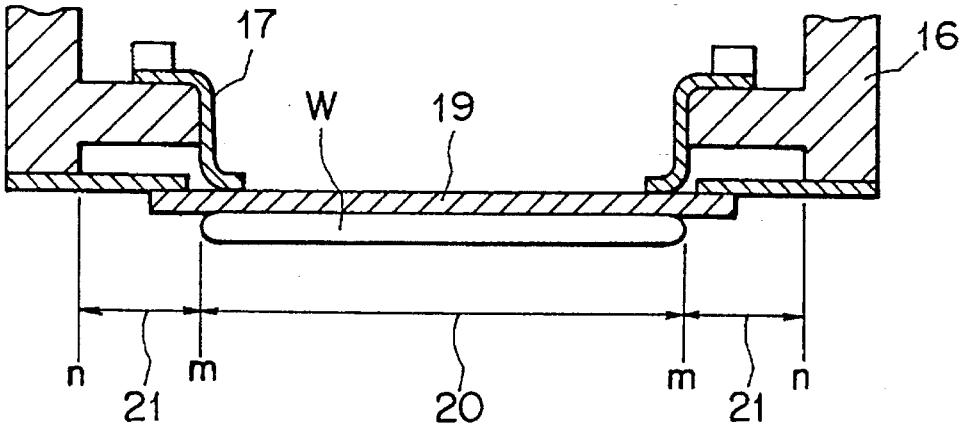
FIG. 9 is a sectional view showing a fourth example embodying the principal part of an apparatus according to the first aspect of the present invention.

In the example 4 of the embodiment, the mounting plate 19 is constructed as shown in FIG. 9 out of a two different substances, one of which is of hard plastic for the holding region 20 and the other of which is of rubber sheet mixed with plastic fibers, plastic fabrics or knitted sheet for the moving region 21. The two regions are connected with each other along the full peripheries.

EXAMPLE 5

Figure 10:
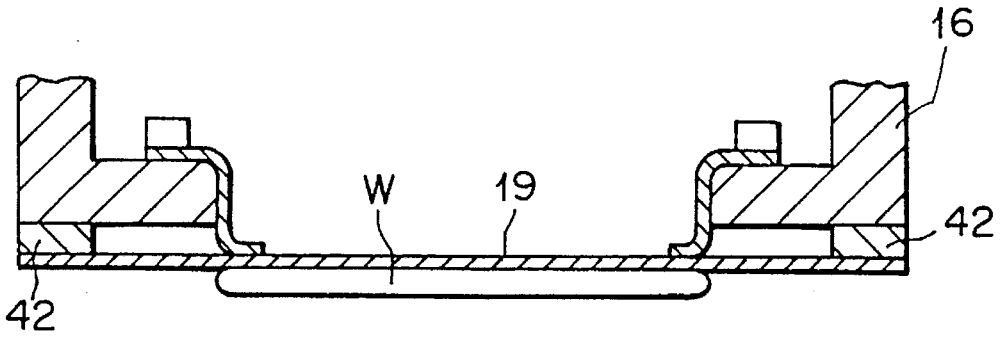
FIG. 10 is a sectional view showing a fifth example of the principal part of an apparatus according to the first aspect of the present invention.

In the example 5, shown in FIG. 10, the wafer mounting plate 19 is secured on the wafer mounting head 16 with an annular soft rubber sheet 42 interposed therebetween as shown in FIG. 10. Examples of vacuum-related structures of the wafer mounting plate 19 are illustrated in the following description.

EXAMPLE 6

Figure 11:
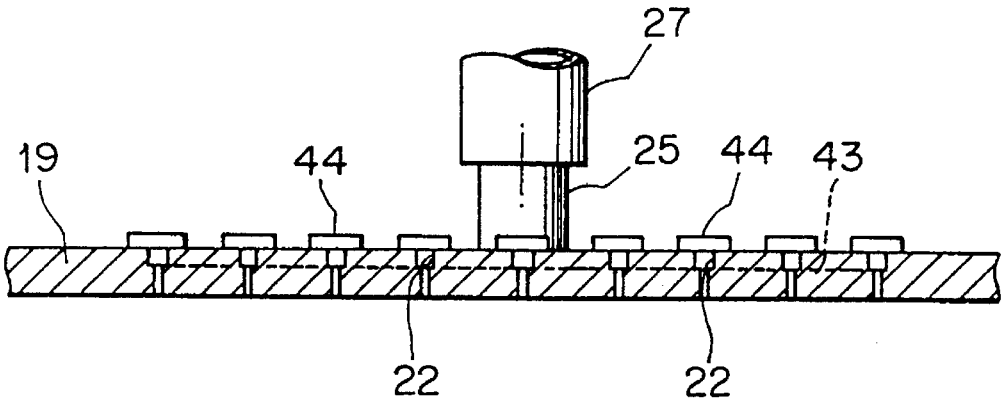
FIG. 11 is a sectional view of a wafer mounting plate used in a sixth example embodying an apparatus according to the first aspect of the present invention.

In the example shown in FIG. 11, a plurality of vacuum chuck holes 22 are arranged on the side mounting a wafer of the wafer mounting plate 19. The chuck holes have a depth reaching the mid point of the thickness and are arranged to locate with one at the centre and the others on concentric circles around the centre.

Spiral groove 43 half way in depth is formed in the upperside surface of the mounting plate 19 to communicate with vacuum chuck holes 22. The spiral groove 43 is sealed with a spirally arranged cord member 44, which is made of soft rubber or soft plastics. A vacuum port 25 is disposed at the centre portion, where the centre of the spiral groove 43 is also located. The vacuum port 25 is connected the flexible hose.

EXAMPLE 7

Figure 12:
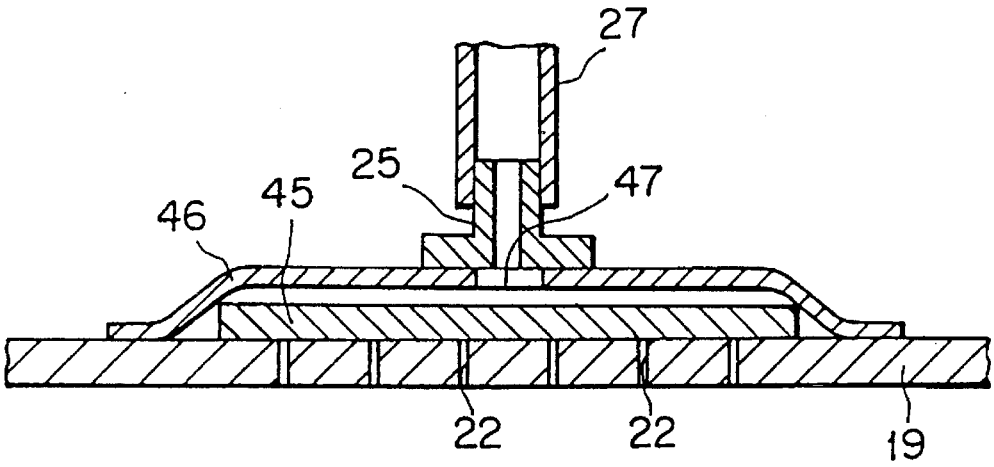
FIG. 12 is a sectional view of a wafer mounting plate used in a seventh example embodying an apparatus according to the first aspect of the present invention.

In the example as shown in FIG. 12 vacuum chuck holes 22 of the mounting plate 19 are formed as through-holes in the bulk and covered with plastic sponge 45 (or aggregate of elastic fibers) on the upper side of the mounting plate 19. The sponge 45 is again covered with a soft rubber cover 46 at the center portion of which a through-hole 47 is opened. The through-hole 47 is communicated with a vacuum source by way of a vacuum port 25 and thereafter a flexible hose 27 disposed in that order.

EXAMPLE 8

Figure 13:
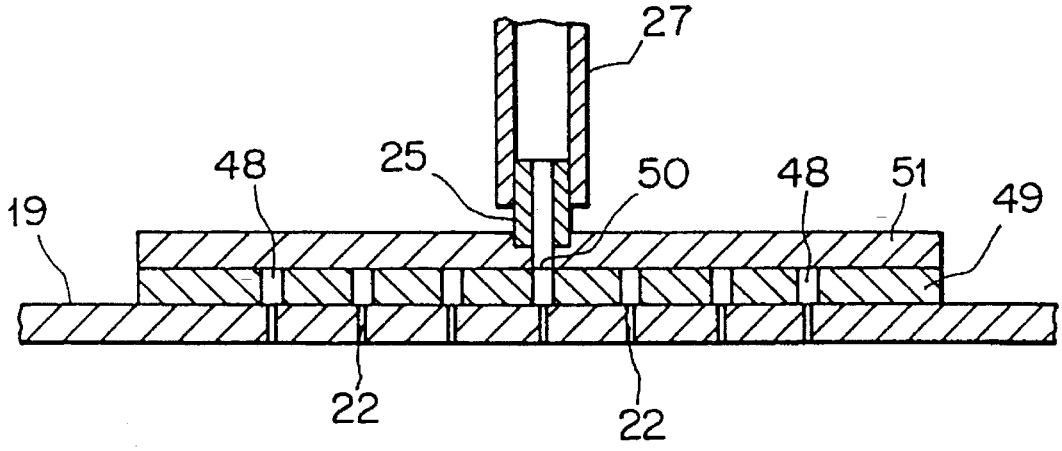
FIG. 13 is a sectional view of a wafer mounting plate used in a eighth example embodying an apparatus according to the first aspect of the present invention.

In the example as shown in FIG. 13, the vacuum chuck holes 22 are formed as a through hole in the bulk of the mounting plate 19. A soft rubber made plate member 49, in which a spiral bottomless groove 48 is formed, is superimposed on the upper side of the mounting plate 19 in such a manner that the vacuum holes are all communicated with the spiral bottomless groove 48. Further a soft rubber cover 51, which has a through-hole 50 in the central portion, is placed on plate member 49 to cover. On occasion, the through-hole 50 is adjusted laterally to communicate with a part of the spiral bottomless groove 48 and furthermore is communicated with a vacuum source by way of a vacuum port 25 and a flexible hose 27.

EXAMPLE 9

Figure 14:
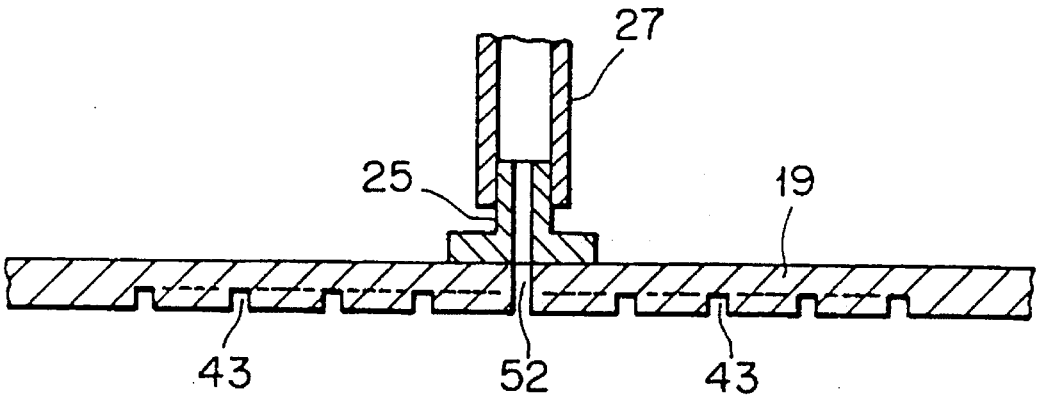
FIG. 14 is a sectional view of a wafer mounting plate used in a ninth example embodying an apparatus according to the first aspect of the present invention.

In the example, as shown in FIG. 14, a wafer mounting plate 19 has a spiral groove 43 on the front side and a through-hole 52 in the center portion. The spiral groove 43 and the through-hole 52 communicates with each other. The through-hole 52 further communicates with a vacuum source by way of a vacuum port 25 and a flexible hose 27.

EXAMPLE 10

Figure 15:
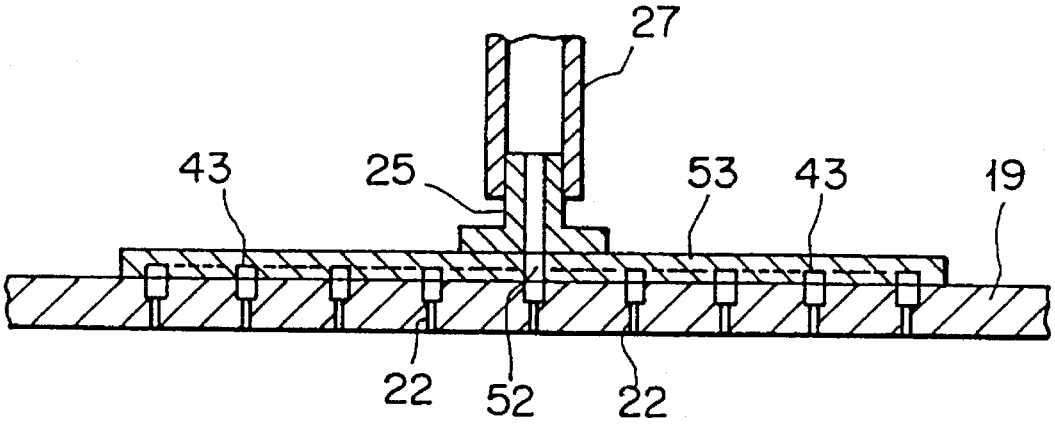
FIG. 15 is a sectional view of a wafer mounting plate used in a tenth example embodying an apparatus according to the first aspect of the present invention.

In the example, as shown in FIG. 15, a wafer mounting plate 19 has a plurality of through-holes 22 formed therein. A soft rubber cover 53 has a spiral groove 43 on the lower side and a through-hole 52 at the centre of the spiral groove 43, where the groove and the through-hole 52 are communicated with each other. And the cover 53 is superimposed with lateral adjustment on the upperside of the mounting plate 19 to communicate with the spiral groove 43 and in addition to that, the through-hole 52 is made to communicate with a vacuum source by way of a vacuum port 25 and a flexible hose arranged in that order.

EXAMPLE 11

Figure 16:
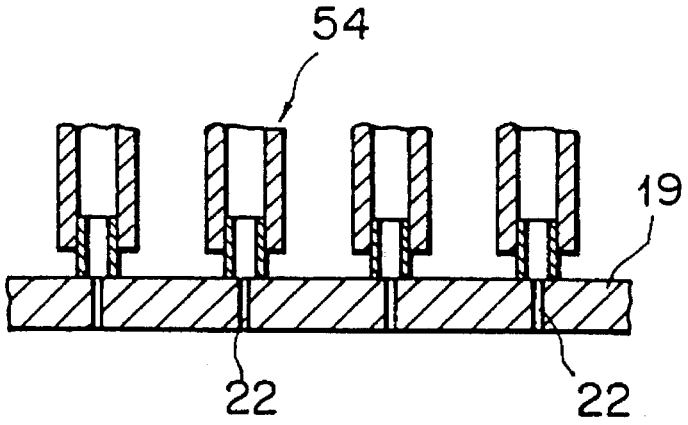
FIG. 16 is a sectional view of a wafer mounting plate used in an eleventh example embodying an apparatus according to the first aspect of the present invention.

In the example, as shown in FIG. 16, vacuum holes 22 are formed as a through-hole in the mounting plate 19, further communicates with a manifold 54 made of soft rubber or soft resin, where a manifold also communicated with a vacuum source by way of a flexible hose (not shown).

Figure 17:
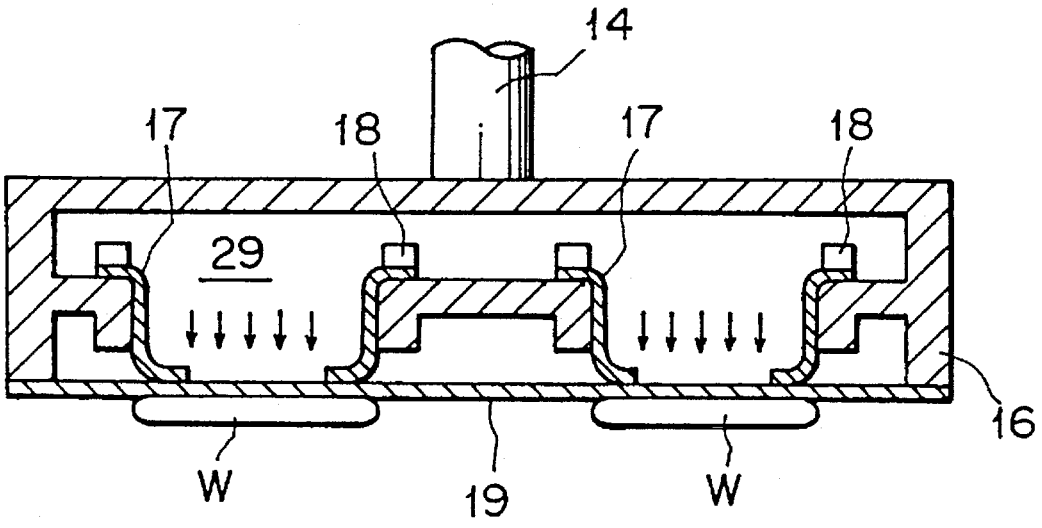
FIG. 17 is a sectional view showing the principal part of an example embodying an apparatus according to the first aspect of the present invention, in which a plurality of wafers are mounted for polishing at a time.
Figure 18:
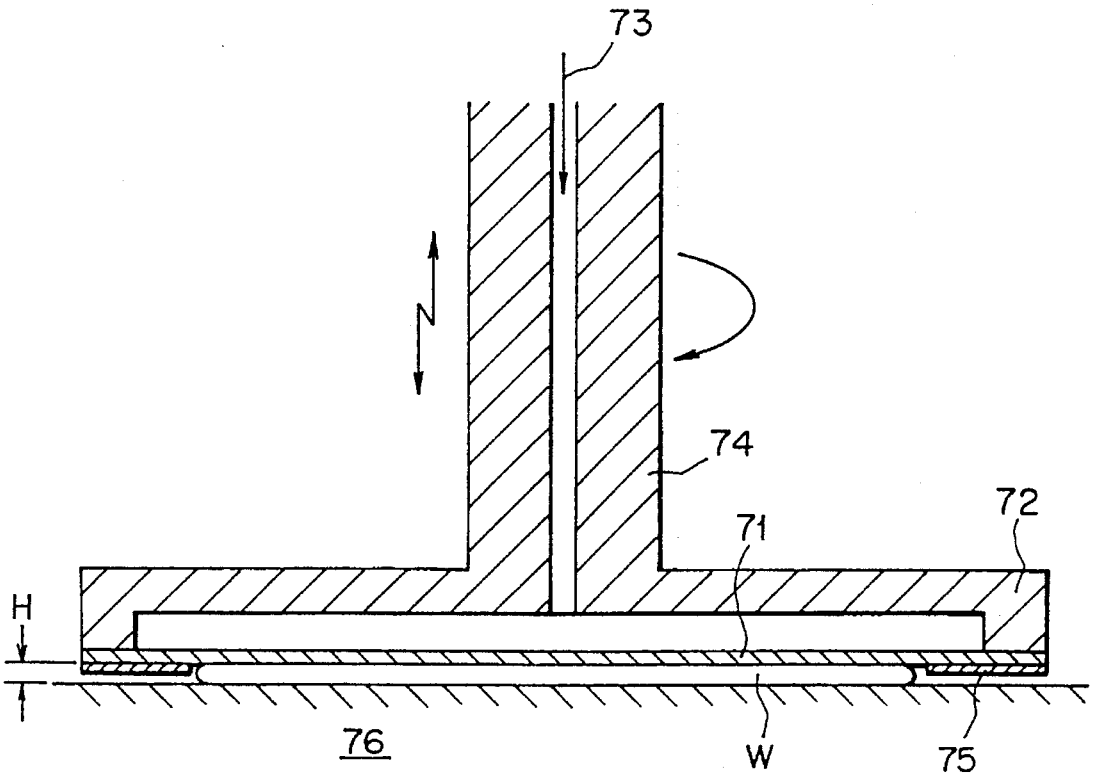
FIG. 18 is a sectional view showing the principal part of an conventional apparatus for polishing semiconductor wafers.
Figure 19:
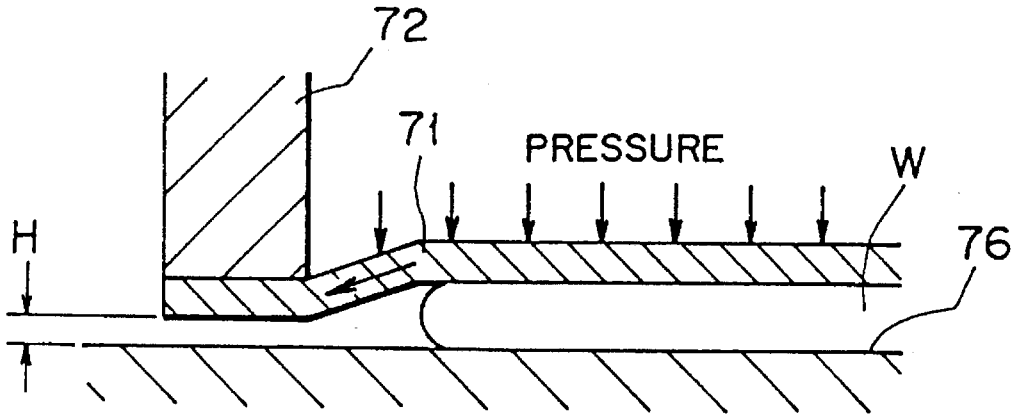
FIG. 19 is a view illustrating the polishing mechanism working in a conventional polishing technique.
Figure 20:
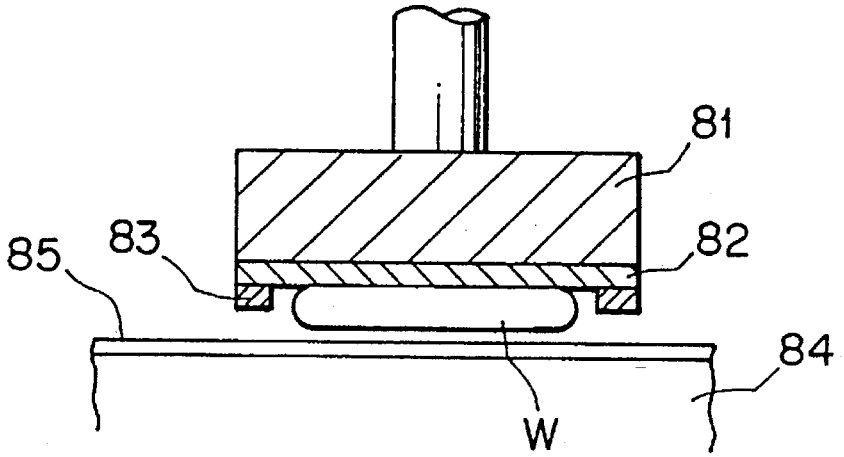
FIG. 20 is a schematic sectional view showing the principal part of another conventional apparatus for polishing semiconductor wafers.
Figures 23A, 23B:
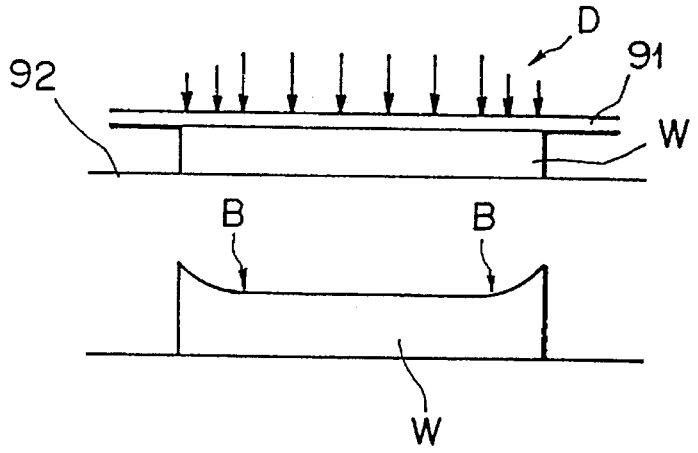
FIG. 23 is a schematic illustration of another undesirable polishing condition of a wafer, in which (a) illustrates a polishing pressure distribution profile on the wafer and (b) is a sectional view of the wafer as polished.

The above mentioned examples are all a single wafer type polishing apparatus, which is designed to polish a wafer at a time. However, according to one of the other preferred embodiments of the first aspect of the present invention, which is shown in FIG. 17, comprises a plurality of annular mounting members 18 and pan-shaped rubber sheets 17 secured to a wafer mounting head 16 and one or more wafer mounting plates 19 or wafer mounting regions are also connected with the lower end of the wafer mounting head 16, which is equipped with a plurality of downward openings. With this type of a polishing apparatus, the mounting plate(s) 19 holds a plurality of wafers to polish during one and the same operation, where a larger sealed space 29 is formed for common use within the wafer mounting head 16.

In the above mentioned apparatus, all the mounting plate(s) 19 are of a type of vacuum chucking but another type of mounting may be allowed to be in use for a method of polishing semiconductor wafers and apparatus therefor still within the spirit and scope of the present invention, in which the backside of a wafer is pressed to attach to a wetted resilient film having a microscopic open pore structure in the surface (hereafter referred to as backing pad fixturing). In the backing pad fixturing, the attractive force between the film and wafer is too weak to resist shear forces during polishing and therefore the wafer edge has to be caged by a retaining ring or a template secured on the lower face periphery of the wafer mounting plate 19.

The second aspect of the present invention will be now illustrated referring to the drawings accompanying to the specification.

EXAMPLE 12

Figure 24:
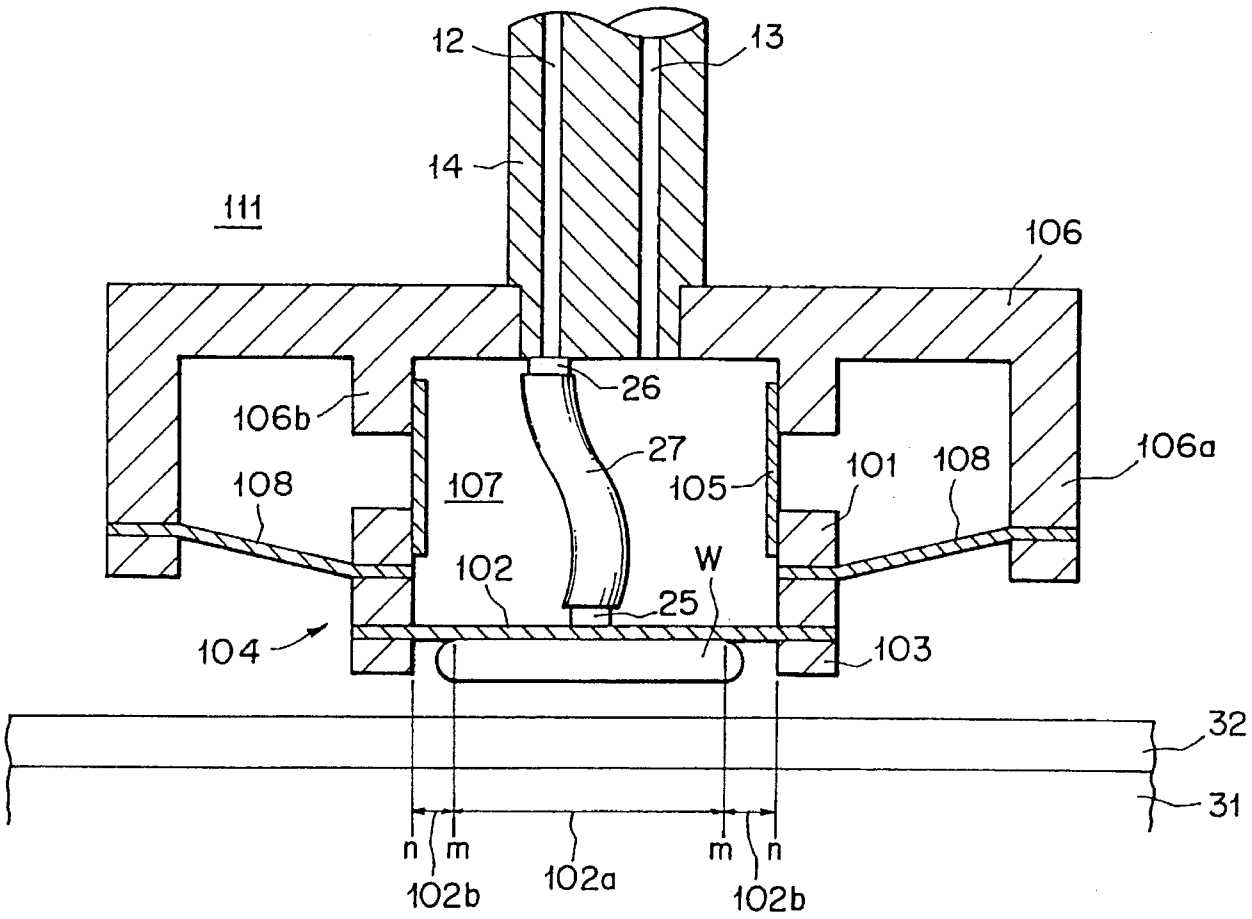
FIG. 24 is a sectional view showing an example embodying the principal part of an apparatus according to a second aspect of the present invention.
Figure 25:
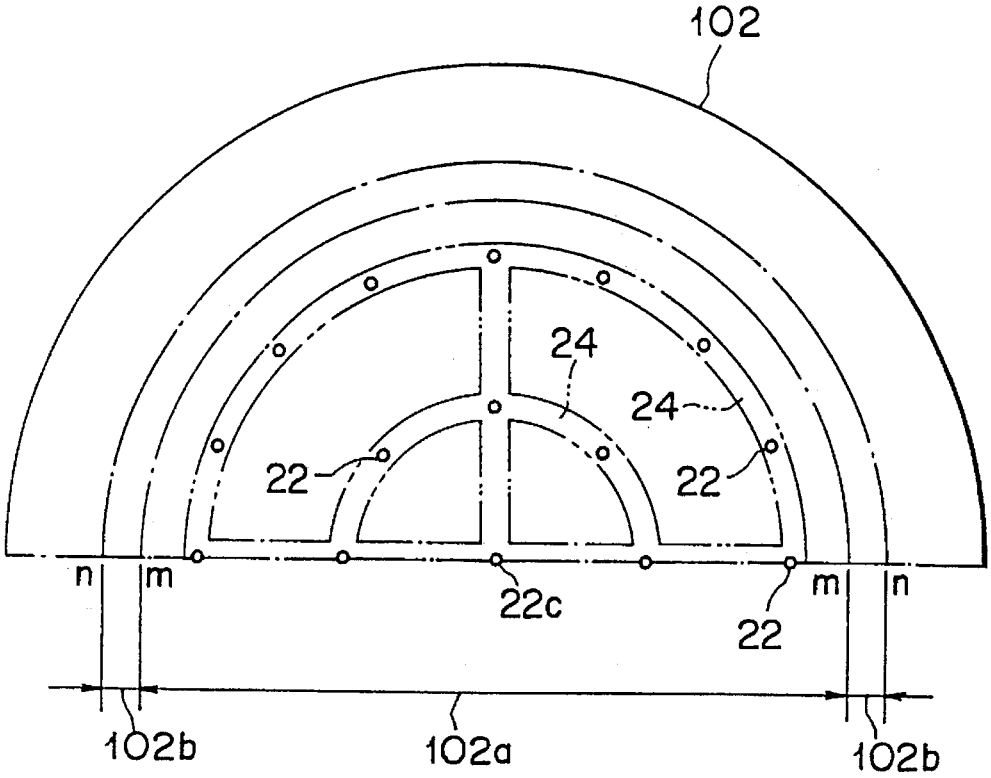
FIG. 25 is a plan view of a wafer mounting plate of the example shown in FIG. 24.
Figure 26:
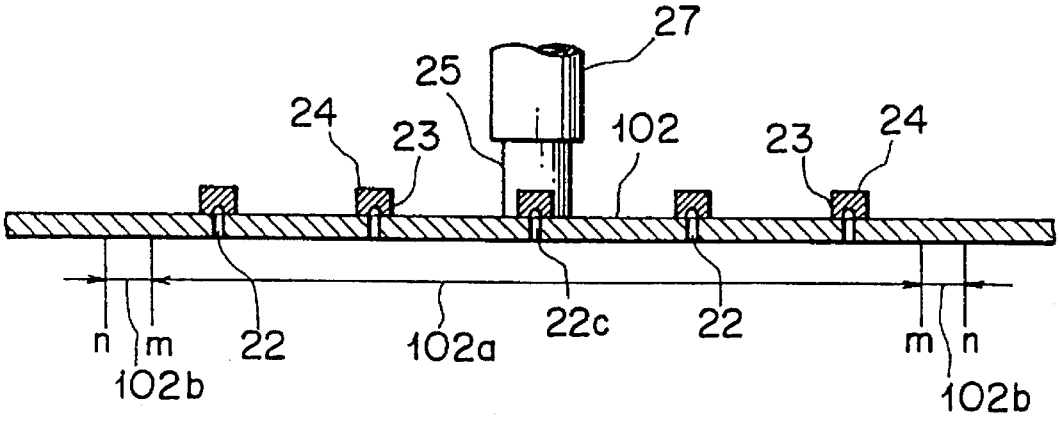
FIG. 26 is a sectional view of the wafer mounting plate shown in FIG. 25.

FIG. 24 is a sectional view showing an example embodying the principal part of a polishing apparatus according to the second aspect of the present invention. FIG. 25 is a plan view of a wafer mounting plate 102 of the example. FIG. 26 is a sectional view of the wafer mounting plate 102 shown in FIG. 25.

As shown in FIG. 24, a wafer holder 111, in which a wafer is held to rotate with which, is disposed above a polishing turn table 31 and is shiftable either upward or downward.

The wafer holder 111 comprises a rotary shaft 14 in which passages 12 and 13 are formed, a wafer mounting head 106, which is fixedly secured to the lower end of the rotary shaft 14, a cylindrical hollow body open downward 106*a* and an annular downward projection 106*b* around the center of the ceiling of the inner space, which are both constituted integrally as parts of the wafer mounting head 106, and a wafer carrier 104 including a wafer mounting plate 102. The wafer carrier 104, which structure is detailed below, is secured to the wafer mounting head 106.

In a more particular explanation here, the wafer carrier 104 is composed of the wafer mounting plate 102 (hereinafter referred to as a mounting plate.) and an annular template 103 secured on the lower face of the mounting plate 102. A short hollow cylinder 101, which is a component of the wafer carrier 104, is connected to the annular downward projection 106*b* on the inner periphery wall at least for sealing to eventually form a sealing space 107. The short hollow cylinder 101 is, on the other hand, connected to near the lower end of the cylindrical hollow body 106*a* by means of a interposing flexible support 108, which may be constructed out of, a plurality of high flexibility metal thin wires arrayed in all the radial directions from and around the short hollow cylinder 101 and combined into the form of an annular sheet, or as alternates an annular rubber, plastic, metallic or the like thin plate. In that way, the wafer carrier 104 is three-dimensionally free to shift a position due to the special structure of being suspended in the air inside the wafer mounting head 106.

The passage 12 is communicated with a vacuum pump-(not shown) by way of a pipe and valve (both not shown) and as shown in FIGS. 25 and 26, vacuum chuck hole 22 (hereinafter referred to a chuck hole) in the mounting plate 102 are communicated with the fluid passage 12 by a vacuum port 25 disposed in the center portion of the mounting plate 102, a flexible hose 27 and a vacuum port 26 disposed in the center portion of the ceiling of the sealed space 107.

The passage 12 is connected to a compressor (not shown) by way of a pipe and a valve (both not shown) and further makes it possible to feed compressed air into the sealed space 107.

A plurality of chuck holes 22 as a through-hole formed in the mounting plate 102 are consisting of one in the central portion of the mounting plate 102 and the others on and along concentric circles about the one in the central portion.

Soft rubber cords 24 (or soft rubber belts, which are small in both width and thickness, which have a long groove longitudinally on one of the sides, are adhered on the upperside of the mounting plate 102, that is, on the face opposite to the face on which a wafer is chucked, not only to seal all the chuck holes but also to make the chuck hole 22*c* in the central portion to communicate with all the other holes 22. The vacuum port 25 is disposed at the chuck hole 22*c* in the central portion of the mounting plate 102.

On the other hand, as shown in FIG. 24, the vacuum port 26 is disposed at the open end of the passage 12. The flexible hose 27 such as a rubber hose and the like is connected between the vacuum ports 25 and 26.

The mounting plate 102 is all constructed out of a hard plastic plate, a hard rubber plate, a metallic plate or the like with a proper flexibility as a physical property. Different flexibilities may be preferably adopted for the respective two regions consisting of a less flexible wafer holding region 102*a*, on which the backside face of a wafer kept in contact, and a more flexible moving region 102*b*, which is annular in shape and which is the portion other than the wafer holding region(as shown in FIGS. 24~26). The two regions are both under the influence of a compressed air at the same time. The mark m in FIGS. 24~26 designates a boundary on which the mounting plate 102 is divided into the wafer holding region 102*a* and the moving region 102*b* and the mark n indicates a boundary between the moving region 102*b* and a fixture portion in the short hollow cylinder 101.

The poorer uniformity is invited to the strength distribution profile of the force applied over the wafer with an increase in width of the moving region 102*b* and therefore better performance with the above structure is obtained from narrower in width and/or higher flexibility of the moving region 102*b*.

As for the hard plastic thin plate constructing the mounting plate 102, selected is thermosetting plastics or heat resistant thermoplastic resin with a moduli of elasticity either for tensile stress or for bending stress of both more than 5000 kgf/cm$^2$ and a thickness in the range of 0.1 mm ~ 1.0 mm.

As for the hard rubber thin plate, selected is the one having a thickness in the range of 0.1 mm ~ 8 mm and being made of ebonite or the like substances with a hardness equal to that of ebonite.

As for the metallic thin plate, stainless steel is selected as a substance and the thickness between 0.05 mm and 0.20 mm.

The moving region 102*b* may be preferably designed to keep as narrow in the width as possible. The thicker wafer holding region 102*a*, for example, may be chosen to increase a relative flexibility of the moving region 102*b* over that of the wafer holding region 102*a*. It is very easy to adjust the flexibility differential between the regions by use of the effect from thickness differential.

The expansion pipe 105 is constructed out of, for example, a soft rubber sheet or the one reinforced by plastic fibres. The highly flexible support 108 may be constructed out of radially arranged thin metallic wires or a thin plate of rubber, plastic or metal. The sealed space 107 preferably coincides with a wafer mounted in cross sectional shape and dimensions both on the side of the wafer carrier 104 and on the side of the wafer mounting head 106.

Next to be described is the polishing action and effects of the above mentioned polishing apparatus by referring to FIGS. 24~27 and FIGS. 4~6.

A wafer W shown in section in FIG. 4 is vacuum chucked on the wafer mounting plate 102 by a vacuum pump actuated. In case that the entire mounting plate 102 is constructed out of hard plastics and the like in a uniform thickness, a wafer W may be chucked on the lower surface of the mounting plate 102 leaving a proper gap between the wafer and the inner periphery of the template 103. On that occasion, the chucking position is not specialized on the mounting plate, but if the mounting plate 102 is constructed out of the two of the holding region 102*a* and more flexible moving region 102*b*, the periphery of the wafer W have to be positioned so as to be precisely coincided with the periphery of the holding region 102*a*.

Compressed air controlled at a pressure is supplied into the sealed space 107 to press the upperside of the mounting plate 102 and further to shift the wafer carrier 104 and presses the wafer W onto a polishing pad 32 on a polishing turn table 31, so that thereafter the wafer is polished under the same conditions as applied in the prior art.

In the apparatus, the wafer carrier 104 is suspended from the wafer mounting head 106 by the expandable and highly flexible members 105 and 108, the rubber cords 24 are used to have the chuck holes 22 of the mounting plate 102 to communicate with each other, such that any loss in the flexibility of the mounting plate 102 is not materialized.

Figure 27:
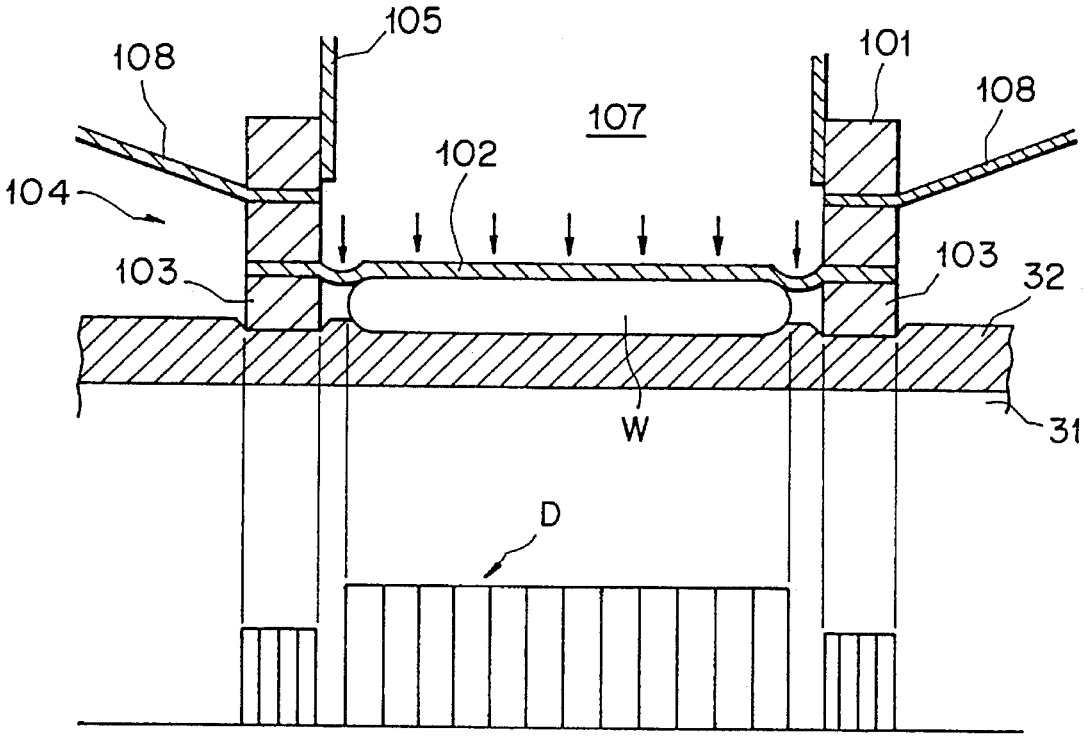
FIG. 27 is a sectional view illustrating the function of the example shown in FIG. 24.

The load applied on the wafer carrier 104 is designed to be received by the template 103 arranged on a part of the lower end face of the mounting plate 102. The wafer holding region 102*a* is made flexible, and the flexible hose 27 is equipped to communicate the vacuum chuck holes 22 with the vacuum passage 12, so that the wafer mounting table 102 is, as shown in FIG. 27, freely displaced in accordance with the pressure of the compressed air as well as is deformable in conformity with the surface contour of the wafer W backside, the entire oxide film 63 on the front face of the wafer is put in close contact with the surface of the polishing pad 32 and the polishing pressure distribution profile D across all the backside face of the wafer comes to be uniform.

Figure 6:
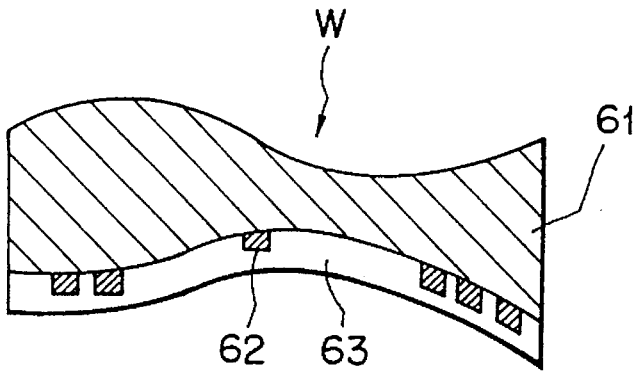
FIG. 6 is a sectional view of a wafer after polishing.

Under such conditions of the apparatus, such projections as minute steps or high spots of the oxide film 64 are selectively polished off without producing sloping at the periphery due to local excess polishing or projections at or around the periphery due to, to the contrary, local poor polishing and thereby the oxide film 63 is polished off under conditions where removal rates are globally uniform all over the surface. The polished wafer W ,as shown in FIG. 6, may be obtained with the oxide film 63 of uniform thickness across the surface.

In the case that the wafer mounting plate 102 is constructed out of the wafer holding region 102*a* lower and the moving region 102*b* higher in the flexibility and besides the periphery of the wafer W is positioned to coincide with the periphery of the wafer holding region 102*a*, so that the pressure in the vicinity of the wafer periphery may be controlled at the same strength as the remainder of the wafer with more ease than a case when all the mounting plate 102 is constructed out of a homogeneous flexible hard plastic and the like. Consequently a uniform overall thickness of the oxide film 63 may be easier to obtain as well as the flatness may be achieved of close tolerances across the wafer surface required for better performance of optical lithography in the making of a semiconductor electronics device.

As for a wafer mounting plate 102, as is the same for the first aspect of the present invention, a wafer mounting plate 102 may be replaced by another wafer mounting plate on which the backing pad fixture is adopted as explained in the first aspect of the present invention.

As apparently understood in the above mentioned description, a method of polishing semiconductor wafers and apparatus therefor according to the first aspect of the present invention is featuring that in the apparatus, a pressure applying region is spatially restricted within the front polishing face of a mounted wafer, and a wafer holding region is flexible and constructed out of a hard plastic plate, so that the polishing pressure is applied in uniform distribution profile all over the wafer and restricted not to give any influence thereof outside of the backside face of the wafer and thereby the wafer is polished with the wafer mounting plate flexibly deformed in conformity with the global surface contour of the backside of the wafer. Consequently in accordance with the first aspect of the present invention, the so-called planarization to be applied in the fabrication process of a semiconductor device is effectively realized in practical sense and thereby an oxide film or an interlevel dielectric film having both a uniform thickness and a flatness to close tolerances across a wafer or substrate may be obtained without any minute high spot left unpolished off. The planarization technique thus achieved may make the processing yield in multilevel interconnections of VLSI technology improved as well as the reliability of a semiconductor device product higher.

Furthermore, in accordance with the second aspect of the present invention, the wafer mounting plate is supported indirectly by the flexible support with the short hollow cylinder lying therebetween, which interferes with transmission of the stress caused by deformation in the flexible support to the wafer displaced three-dimensionally in a body with the other parts of the wafer carrier and besides is flexibly deformed to conform with the global surface contour of the backside of the wafer mounted under uniform strength distribution profile of polishing pressure across the entire wafer during a polishing operation, so that a polished wafer may be produced without slopings due to over polishing or high spots due to underpolishing along or in the vicinity of the periphery and thereby according to the second aspect, a front referenced polishing of a higher performance may be guaranteed to achieve.

While the present invention has been particularly shown and described with reference to preferred embodiments thereof, it will be understood by those skilled in the art that the foregoing and other changes in form and detail can be made therein without departing from the spirit and scope of the present invention.

What is claimed is:

1. A method of polishing semiconductor wafers including the steps of holding a semiconductor wafer on a wafer mounting region of a first side of a wafer mounting plate, said wafer mounting plate being sufficiently flexible to conform to a contour of a back side of said semiconductor wafer, and supplying a compressed fluid on a restricted region of another side of said wafer mounting plate corresponding to said wafer mounting region.

2. A method of polishing semiconductor wafers including the steps of holding a semiconductor wafer on a wafer mounting region of a first side of a wafer mounting plate, a periphery of said wafer substantially coinciding with a periphery of said wafer mounting region, comforming said wafer mounting region to a contour of a back side of said semiconductor wafer with a compressed fluid supplied on a restricted region of another side of said wafer mounting plate corresponding to said wafer mounting region, and pressing said semiconductor wafer against a polishing surface with said compressed fluid by flexure of a motion region of said wafer mounting plate surrounding said wafer mounting region of said wafer mounting plate.

3. An apparatus for polishing semiconductor wafers including a flexible wafer mounting plate displaceably disposed at an opening of a wafer holder, said wafer holder being connected to a wafer mounting head, said wafer mounting plate having a wafer holding region formed of relatively hard substance, means for sealing said opening of said wafer holder to said wafer holding region, said means for sealing being in the form of a ring-shaped member and having greater flexibility than said relatively hard substance, means for holding a semiconductor wafer against said wafer holding region on a first side of said wafer mounting plate, and means for supplying a compressed fluid against a region of a second side of said wafer mounting plate corresponding to said wafer holding region.

4. The apparatus as recited in claim 3, wherein said wafer holding region is centrally located on said wafer mounting plate and an inner periphery of said ring-shaped member is fixed to and along a periphery of said wafer holding region, forming a moving region, and wherein a periphery of said wafer mounting plate is secured to said wafer holder.

5. The apparatus as recited in claim 4, wherein said entire wafer mounting plate includes said ring-shaped member and is formed of one and the same substance, said moving region being smaller in thickness than said wafer holding region.

6. The apparatus as recited in claim 4, wherein said entire wafer mounting plate includes said ring-shaped member and is formed of one and the same substance and uniform in thickness, said moving region being perforated by through holes.

7. The apparatus as recited in claim 4, wherein a periphery of said wafer mounting plate is fixed to said wafer mounting head with a soft rubber ring-shaped member along a periphery of said wafer mounting plate.

8. The apparatus as recited in claim 3, wherein said means for holding a semiconductor wafer includes a plurality of vacuum chuck holes in a wafer holding region of said wafer mounting plate, and means including a flexible hose for communicating a vacuum source to said vacuum chuck holes.

9. The apparatus as recited in claim 8, wherein said vacuum chuck holes are formed as through holes in said wafer mounting plate, and wherein said means for communicating a vacuum source to said vacuum chuck holes includes cords of a soft material having a groove formed therein and secured on said second side of said wafer mounting plate with said groove communicating with said through holes.

10. The apparatus as recited in claim 9, further including at least one of a further wafer holding region on said wafer mounting plate and a further mounting plate having a further wafer holding region, said wafer holding region and said further wafer holding region each being secured to said wafer mounting head with individual ring members.

11. The apparatus as recited in claim 8, wherein said vacuum chuck holes are formed as through holes in said wafer mounting plate, said apparatus further including at least one of a sponge and an aggregate of fibers covering said through holes, and cover means for covering said at least one of a sponge and an aggregate of fibers covering said through holes, said cover means further including a through hole means for communicating with said vacuum source through said flexible hose.

12. The apparatus as recited in claim 11, further including at least one of a further wafer holding region on said wafer mounting plate and a further mounting plate having a further wafer holding region, said wafer holding region and said further wafer holding region each being secured to said wafer mounting head with individual ring members.

13. The apparatus as recited in claim 8, wherein said vacuum chuck holes are formed as through holes in said wafer mounting plate, said apparatus further including a soft rubber plate having a spiral bottomless groove formed therein arranged to communicate with said through holes, and cover means further including a through hole means for communicating said bottomless groove with said vacuum source through said flexible hose.

14. The apparatus as recited in claim 13, further including at least one of a further wafer holding region on said wafer mounting plate and a further mounting plate having a further wafer holding region, said wafer holding region and said further wafer holding region each being secured to said wafer mounting head with individual ring members.

15. The apparatus as recited in claim 8, further including at least one of a further wafer holding region on said wafer mounting plate and a further mounting plate having a further wafer holding region, said wafer holding region and said further wafer holding region each being secured to said wafer mounting head with individual ring members.

16. An apparatus for polishing semiconductor wafers including a wafer mounting head having a cylindrical hollow body and an annular projection within said cylindrical hollow body, a flexible wafer mounting plate concentrically positioned with an end of a short hollow cylinder, a template arranged on a surface of said wafer mounting plate to surround a wafer mounted thereon, and means for sealingly connecting said annular projection and an end of said short hollow cylinder to form an expandable sealed space, means for flexibly connecting said short, hollow cylinder and a portion of said cylindrical hollow body, and means for communicating said expandable sealed space with a source of compressed fluid.

17. The apparatus as recited in claim 16, wherein said flexible wafer mounting plate is formed of a flexible hard plate and has a wafer holding region and an annular region surrounding said wafer holding region, said annular region having greater flexibility than said wafer holding region.

18. The apparatus as recited in claim 16, wherein a cross-section of said expandable sealed space roughly coincides with a perimeter of a semiconductor wafer.

* * * * *